US007240670B2

(12) United States Patent
Alger, II et al.

(10) Patent No.: US 7,240,670 B2
(45) Date of Patent: Jul. 10, 2007

(54) EXTENDED DURATION HIGH-ENERGY IGNITION CIRCUIT

(75) Inventors: Terrence Francis Alger, II, San Antonio, TX (US); Barrett Wade Mangold, Atascosa, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/420,389

(22) Filed: May 25, 2006

(65) Prior Publication Data

US 2006/0266339 A1 Nov. 30, 2006

Related U.S. Application Data

(60) Provisional application No. 60/684,839, filed on May 26, 2005.

(51) Int. Cl.
*F02P 3/02* (2006.01)

(52) U.S. Cl. ..... 123/620; 123/654

(58) Field of Classification Search ..... 123/620, 123/653, 654, 601, 604, 605; 315/209 CD
See application file for complete search history.

(56) References Cited

U.S. PATENT DOCUMENTS 3,677,253 A * 7/1972 Oishi et al. ..... 123/598
4,648,367 A * 3/1987 Gillbrand et al. ..... 123/406.26

OTHER PUBLICATIONS

Rohwein et al., Automotive Ignition Transfer Efficiency, Society of Automotive Engineers, Inc., 6 pages, 2002.

* cited by examiner

*Primary Examiner*—Hieu T. Vo
(74) *Attorney, Agent, or Firm*—Baker Botts LLP

(57) ABSTRACT

A follow-on circuit for extending the duration of the spark provided by a spark plug. The circuit is connected between the coil secondary and the spark gap, and has a capacitor that discharges to the point of connection through a resistor and inductor. The resistor may be made variable to control the amount and duration of the follow-on current, and hence the energy and duration of the spark event. The circuit may also be used with other ignitors and non-coil ignition circuits.

17 Claims, 2 Drawing Sheets

EXTENDED DURATION HIGH-ENERGY IGNITION CIRCUIT

CROSS-REFERENCE TO RELATED APPLICATIONS

This application claims the benefit of U.S. Provisional Application No. 60/684,839 filed on May 26, 2005, which is incorporated herein by reference in its entirety.

TECHNICAL FIELD OF THE INVENTION

This invention relates to engine ignition systems, and more particularly to an ignition circuit for providing an extended duration charge to an igniter.

BACKGROUND OF THE INVENTION

Recent research has shown that increased levels of exhaust gas recirculation (EGR) in spark ignition engines can enable operation at higher compression ratios and loads than were previously possible, due primarily to a reduction in knock tendency. Increasing the amount of dilution by increasing the air/fuel ratio has also been shown to have similar effects.

Implementation of these features gives rise to the problem of ignition and flame propagation at these increased dilution levels. Several companies now sell enhanced ignition circuits and new types of igniters to improve ignitability and promote faster burn rates in the engine. Two examples are "plasma jet" and "railplug" igniters.

DETAILED DESCRIPTION OF THE INVENTION

Figure 1:
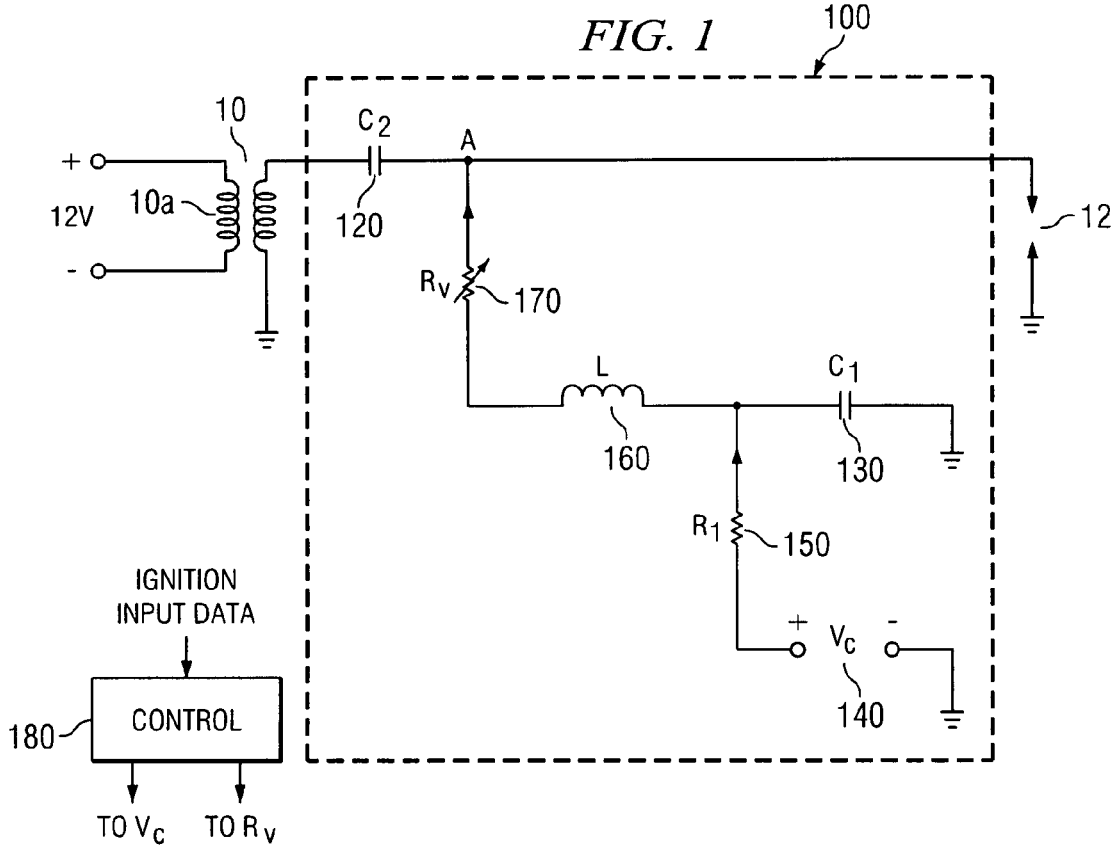
FIG. 1 is a schematic of one embodiment of the extended duration ignition circuit in accordance with the invention.

FIG. 1 is a schematic of one embodiment of an extended duration spark circuit 100 in accordance with the invention. Circuit 100 is typical of an automobile ignition system, whose switching may be performed using a mechanical system (distributor) or a solid state electronic system. Circuit 100 has a low voltage primary ignition coil 10*a*, which will induce a high voltage in the secondary coil 10, which is then directed to a spark plug represented by spark gap 12.

Advances in automotive ignition systems have led to a variety of ignition coil alternatives. Rather than using a single coil and switching the spark voltage to a number of spark plugs, some engines use a "coil on plug" (COP) design, in which each spark plug has its own coil mounted on top. In a typical COP ignition system, a crankshaft position sensor generates a basic timing signal by reading notches on the crankshaft, flywheel or harmonic balancer. The crank sensor signal goes to the a control module, where it is used to determine firing order and turn the individual ignition coils on and off.

Regardless of the placement of, or number of coils, the ignition system operation is essentially the same. Coil 10 is a conventional ignition coil. Coil 10 has a low primary resistance, and steps up the primary system voltage from 12 volts to as much as 40,000 volts to produce a spark for the spark plug.

For purposes of this description, circuit 100 is described in terms of use with a spark plug, represented schematically in FIG. 1 by spark gap 12, used in an automotive (internal combustion engine) ignition system. However, the same concepts could apply to extending the duration of electrical energy applied to ignition circuits other than those having a coil as the energy source and to igniters other than spark igniters. In other ignition circuits, the battery and/or coil could be replaced by another type of energy source, and the add-on current circuit of the present invention could be placed between the energy source and the igniter.

Experience has shown that for very dilute mixtures, a longer duration spark leads to better ignitability, by increasing the probability of an ignitable mixture moving through the spark gap. To this end, coil 10 is complemented with a follow-on circuit 100, which is imposed between the secondary ignition coil 10*b* and the spark plug gap 12. A significant feature of the circuit 100 is a resistor that allows an ignition control unit 180 to vary the duration of the spark event.

More specifically, ignition coil 10 is connected to a blocking capacitor 120, which prevents the low frequency discharge of a follow-on capacitor 130 from flowing into the secondary coil 10*b*. The follow-on capacitor 130 is charged from a voltage source 140 through a resistor 150. Voltage source 140 can be a variable voltage source. Resistor 150 defines the charge time of the capacitor 130 and limits the spark duration.

Capacitor 130 discharges to Node A, which is interposed between coil 10 and the spark gap 12. Discharge is through an inductor 160 and a resistor 170. Inductor 160 helps limit the peak current, whereas resistor 170 acts primarily to set the time constant of the circuit 100. In the example of FIG. 1, resistor 170 is a variable resistor.

Figure 2:
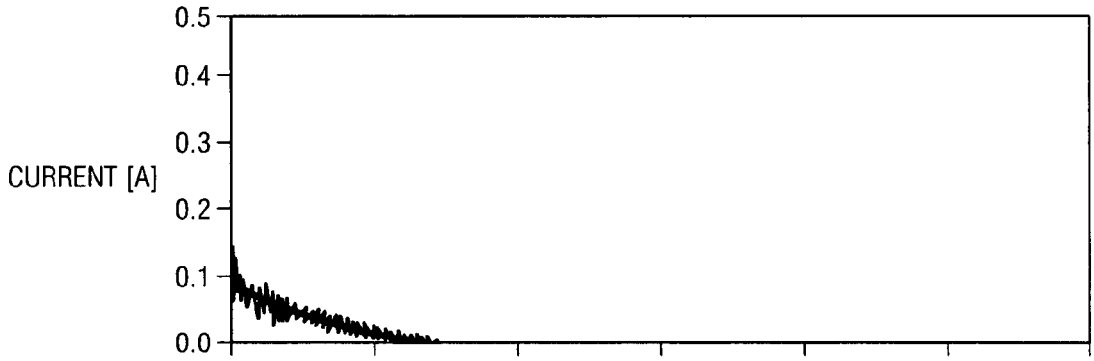
FIGS. 2 and 3 compare the spark duration of a conventional coil ignition circuit (FIG. 2) to that of an extended duration coil ignition circuit in accordance with the invention (FIG. 3).
Figure 3:
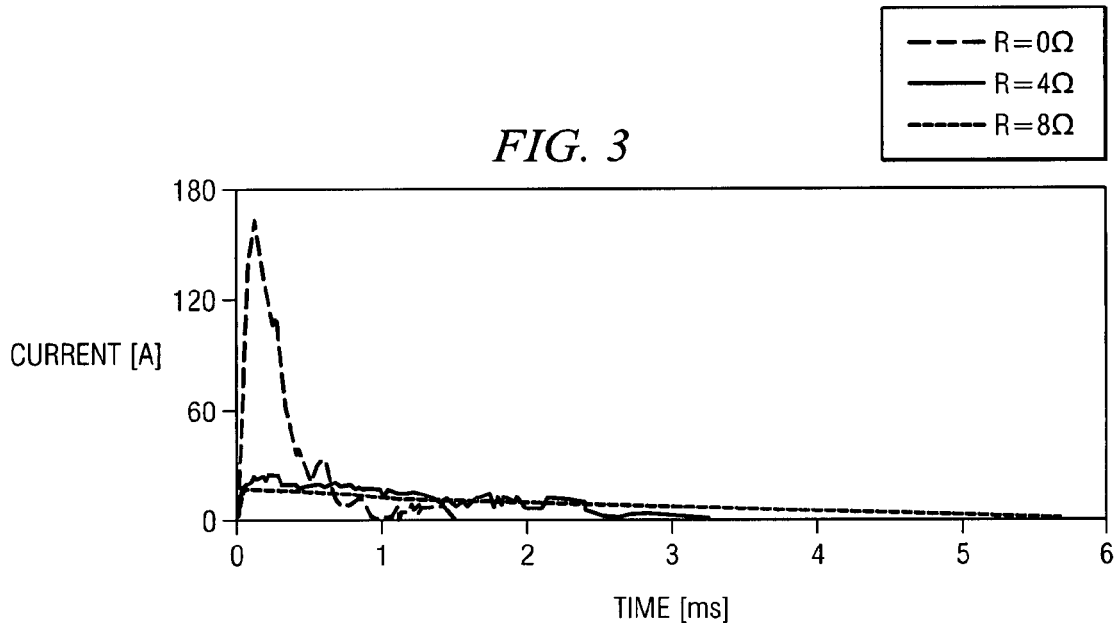

FIGS. 2 and 3 compare the spark duration of a conventional coil ignition circuit (FIG. 2) to that of a coil ignition circuit having an extended duration (follow-on current) circuit, such as circuit 100, in accordance with the invention (FIG. 3).

Specifically, FIGS. 2 and 3 show the effect of adding the follow-on circuit 100 to the stock coil 10. Circuit 100 provides a follow-on current, which is capable of extending the spark event by at least a factor of 6 at the longest duration. The values for capacitor 130 and inductor 160 are 330 μF and 250 μH, respectively.

FIG. 3 further illustrates the effect of varying the value of the variable resistor 170. Generally, a higher resistance results in higher current, but with shorter duration. In a production engine application, the charging voltage and resistance of circuit 100 can be a part of an engine control algorithm, both to ensure optimum ignitability and to extend plug life, by only using the maximum energy when it is absolutely necessary.

Figure 4:
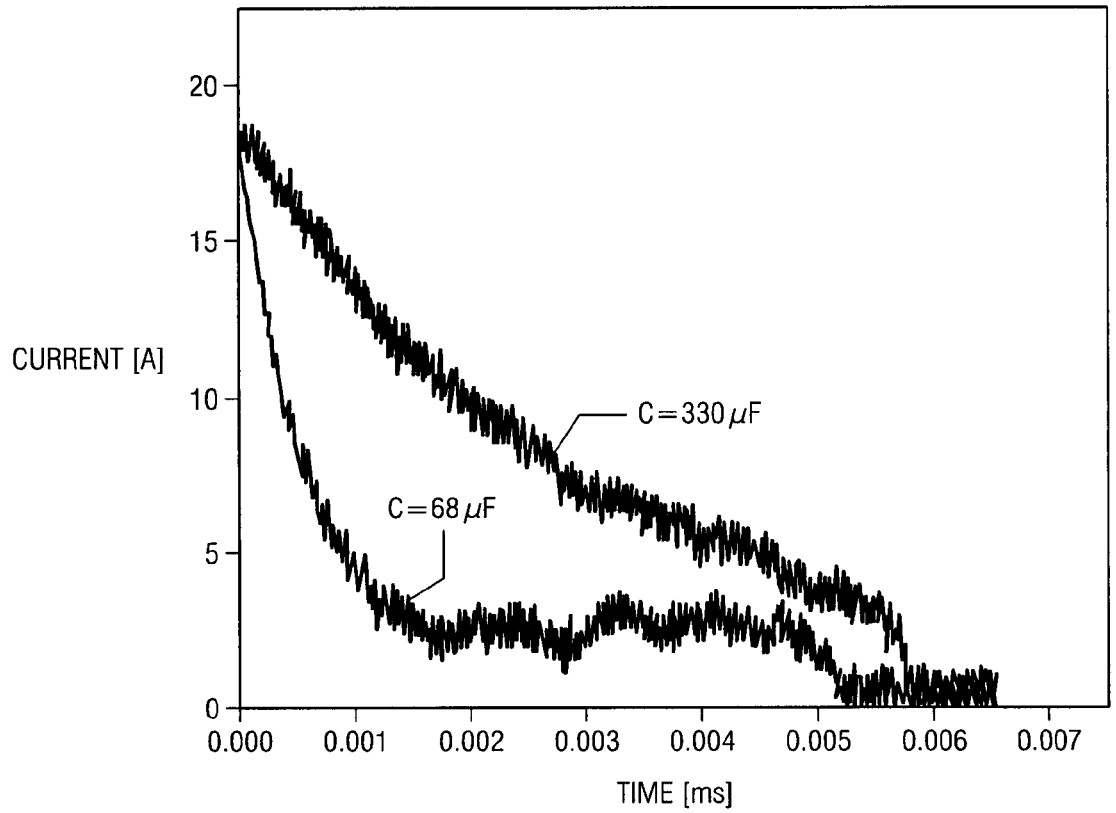
FIG. 4 illustrates the effect of changing the capacitance of the circuit of FIG. 1 on the spark duration and current levels.

FIG. 4 illustrates the effect of changing the value of capacitor 130 on the spark duration and current levels. The values for resistor 170 and inductor 160 are 8 ohms and 250 μH, respectively. Generally, a higher capacitance results in higher current without substantial reduction in spark duration.

It is important to note from a durability standpoint, that the most desirable result is a combination of capacitance, inductance and resistance that results in the longest spark at the lowest current levels possible. Circuit 100 can be used to provide improved ignition and burn rates, and is especially useful in dilute air/fuel conditions.

Control unit 180 is used to control the input parameters for resistor 170 and voltage source 140. As explained above, control unit 180 may receive a variety of signals for controlling ignition timing as well as spark duration. It executes the ignition control algorithm in accordance with the guidelines discussed above, and is implemented with appropriate processing and memory devices. It may be a stand-alone unit or integrated with other engine control processing devices and systems.

The invention claimed is:

1. An ignition circuit for use in an automotive ignition system having a primary ignition source and at least one spark igniter:

a coil for stepping up voltage from the primary ignition source;

a follow-on circuit having a follow-on capacitor with its charged terminal connected to a follow-on circuit node between the secondary of the coil and the positive terminal of the igniter; an inductor connected between the first resistor and the follow-on circuit node; and a resistor connected in series with the inductor, between the inductor and the follow-on circuit node; wherein the follow-on capacitor discharges through the inductor and the resistor; and a voltage source for supplying a voltage to the charged terminal of the follow-on capacitor.

2. A follow-on current circuit for use in an ignition system having a primary ignition energy source and at least one igniter:

a follow-on capacitor with its charged terminal connected to a follow-on circuit node between the energy source and the positive terminal of the igniter;

an inductor connected between the first resistor and the follow-on circuit node;

and a resistor connected in series with the inductor, between the inductor and the follow-on circuit node;

wherein the follow-on capacitor discharges through the inductor and the resistor; and a voltage source for supplying a voltage to the charged terminal of the follow-on capacitor.

3. An ignition circuit for use with an ignition coil and an igniter, comprising:

a follow-on circuit having a follow-on capacitor with its charged terminal connected to a follow-on circuit node between the secondary of the coil and the positive terminal of the igniter; an inductor connected between the first resistor and the follow-on circuit node; and a resistor connected in series with the inductor, between the inductor and the follow-on circuit node; wherein the follow-on capacitor discharges through the inductor and the resistor; and a voltage source for supplying a voltage to the charged terminal of the follow-on capacitor.

4. The circuit of claim 3, wherein the resistor is a variable resistor.

5. The circuit of claim 3, further comprising a blocking capacitor connected between the follow-on circuit node and the secondary of the coil.

6. The circuit of claim 3, wherein the voltage source is a variable voltage source.

7. The circuit of claim 3, wherein the igniter is a spark igniter.

8. The circuit of claim 3, further comprising a second resistor between the voltage source and the charged terminal of the follow-on capacitor.

9. The circuit of claim 3, wherein the coil is a coil-on-plug type coil.

10. The circuit of claim 3, further comprising an ignition control unit operable to deliver control signals to the follow-on circuit.

11. The circuit of claim 3, further comprising an ignition control unit operable to deliver control signals to the follow-on circuit.

12. A method of extending the duration of energy applied to an igniter of an ignition system having at least one coil, comprising:

imposing a follow-on circuit between the coil and the igniter, such that current from the follow-on circuit flows to a connection node between the secondary winding and the igniter;

wherein the follow-on circuit has at least a capacitor, an inductor, and a resistor in series to the node, such that the capacitor discharges to the connection node through the inductor and the resistor; and wherein the capacitor receives a voltage from a voltage source at a charged terminal of the capacitor.

13. The method of claim 12, further comprising connecting a blocking capacitor between the node and the coil.

14. The method of claim 12, further comprising varying the resistance of the resistor to achieve a desired spark duration.

15. The method of claim 12, further comprising varying the resistance of the resistor during engine operation in response to engine operating conditions.

16. The method of claim 12, further comprising varying the charging voltage from the voltage source.

17. The method of claim 12, further comprising varying the charging voltage from the voltage source in response during engine operation in response to engine operating conditions.

* * * * *